United States Patent [19]

Hillberg

[11] 4,221,066

[45] Sep. 9, 1980

[54] FIREARM GRIP ASSEMBLY

[75] Inventor: Robert L. Hillberg, Cheshire, Conn.

[73] Assignee: Wildey Firearms Company, Inc., Cold Spring, N.Y.

[21] Appl. No.: 7,191

[22] Filed: Jan. 29, 1979

[51] Int. Cl.[3] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 812,016 | 2/1906 | Bye | 42/71 P |
| 1,531,796 | 3/1925 | Loomis | 42/71 P |

*Primary Examiner*—Charles T. Jordan

*Attorney, Agent, or Firm*—McCormick, Paulding & Huber

[57] ABSTRACT

Non-metallic grip panels slidably received within recesses in opposite sides of a pistol handle are releasably retained in assembly with the handle by a flat retaining spring. Each panel carries an associated retaining spring which has a free end portion biased into an associated cavity in the handle. The retaining springs are wholly concealed when the grip panels are assembled with the handle and are accessible through a magazine well formed in the handle to facilitate release.

9 Claims, 9 Drawing Figures

FIREARM GRIP ASSEMBLY

BACKGROUND OF THE INVENTION

This invention relates in general to firearms and deals more particularly with an improved pistol grip assembly for a firearm. A high quality firearm of a type which includes a pistol grip, defined by a portion of its frame, usually has non-metallic grip inserts which provide an attractive, comfortable gripping surface. Such panels are usually releasably retained in assembly with the frame of the firearm by one or more exposed fasteners, which facilitate removal of the grip panels from the frame when the firearm is fully stripped for cleaning. The present invention is concerned with an improved pistol grip assembly of the afore-described general type which includes non-metallic grip panels releasably retained in assembly with a grip defining portion of a firearm frame by fasteners which are wholly concealed when the panels are assembled with the frame.

SUMMARY OF THE INVENTION

In accordance with the invention, a firearm grip panel assembly includes a handle member which has a longitudinally extending channel and a panel member received in the channel. Coengaging means on the handle and the panel member restrain the panel member against lateral movement within the channel and relative to the handle member. Concealed means carried by one of the members which comprise the handle member and panel member is engageable with the other of the members for releasably retaining the panel member in assembly with the handle member.

DETAILED DESCRIPTION OF PREFERRED EMBODIMENT

Figure 1:
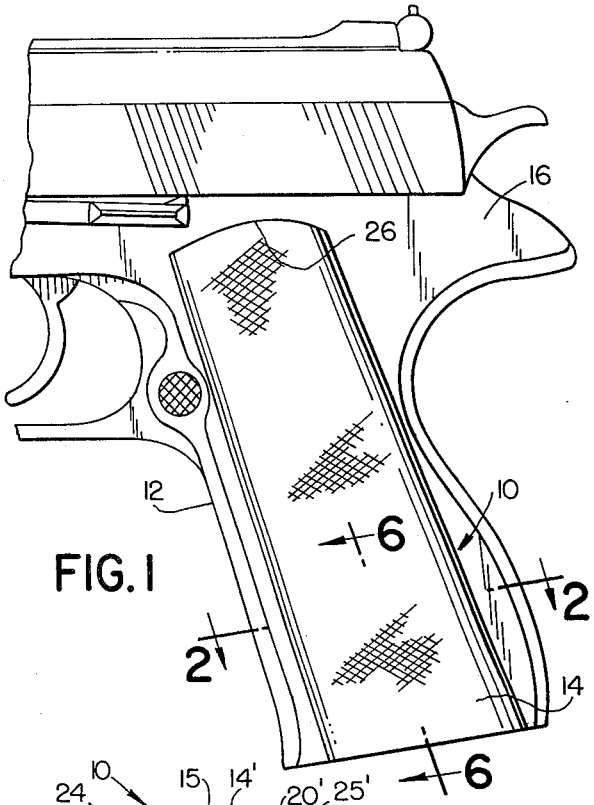
FIG. 1 is a fragmentary side elevational view of a portion of a pistol having a grip assembly embodying the present invention.
Figure 2:
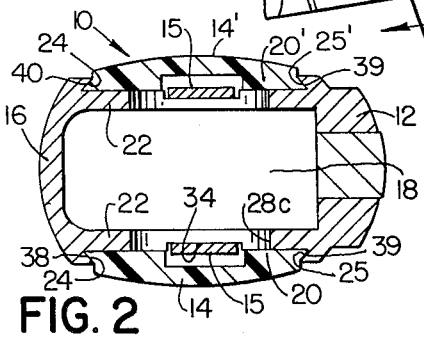
FIG. 2 is a somewhat enlarged sectional view taken along the line 2—2 of FIG. 1.

Turning now to the drawing, and referring particularly to FIGS. 1 and 2, a portion of a pistol is shown which has a grip panel assembly embodying the present invention and indicated generally by the reference numeral 10. The grip panel assembly 10 generally comprises a handle member 12, a pair of panel members 14 and 14', and concealed springs 15, 15 (one shown) for releasably retaining the panel members 14, 14' in assembly with the handle member 12, as will be hereinafter further described.

Figure 3:
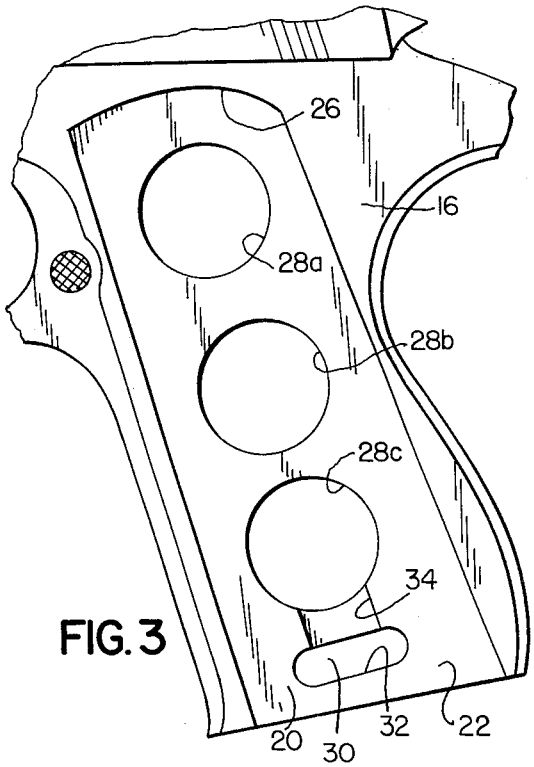
FIG. 3 is similar to FIG. 1 but somewhat enlarged and shows a handle portion of the pistol with the panel members removed therefrom.
Figure 6:
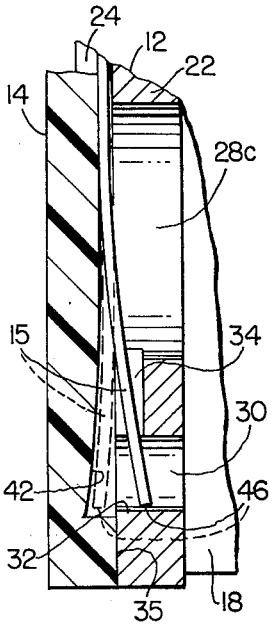
FIG. 6 is a somewhat enlarged fragmentary sectional view taken along the line 6—6 of FIG. 1.

The illustrated handle member 12 comprises a part of the pistol frame, which is made of metal and designated by the numeral 16. A conventional magazine well 18 formed within the handle member 12 opens outwardly through its lower end, as it appears oriented in FIG. 1. Channels 20, 20', which may or may not be substantially identical but of opposite hand, are formed in opposite sides of the handle member and extend longitudinally of the handle member and open laterally outwardly through its opposite sides, as best shown in FIG. 2. Each channel also opens outwardly through the lower end of the handle member and is defined by an inner wall which comprises a wall of the magazine well 18. The illustrated channel 20, best shown in FIGS. 2 and 3, is typical and defined by an inner wall 22, opposing front and rear walls 24 and 25, and a downwardly facing arcuate upper end wall 26. The front and rear walls 24 and 25 are inclined laterally outwardly and toward each other from the inner wall 22, as best shown in FIG. 2, and diverge downwardly from the upper end wall 26 toward the open lower end of the channel 20, as shown in FIG. 1. A longitudinal series of circular holes **28*a*–28*c* open through the inner wall 22 and communicate with the magazine well 18, as shown in FIG. 2. The holes 28*a*–28*c* serve to lighten the gum frame, however, the hole 28*c* is provided for an additional purpose which will be hereinafter further discussed. A transversely extending slot 30, formed in the inner wall 22 below the hole 28*c*, is partially defined by a transversely extending and upwardly facing surface 32. A shallow longitudinally extending and laterally outwardly opening channel shaped recess 34 is formed in the inner wall 22 and extends between and opens into the slot 30 and the hole 28*c* immediately thereabove, as best shown in FIGS. 3 and 6**.

Figure 4:
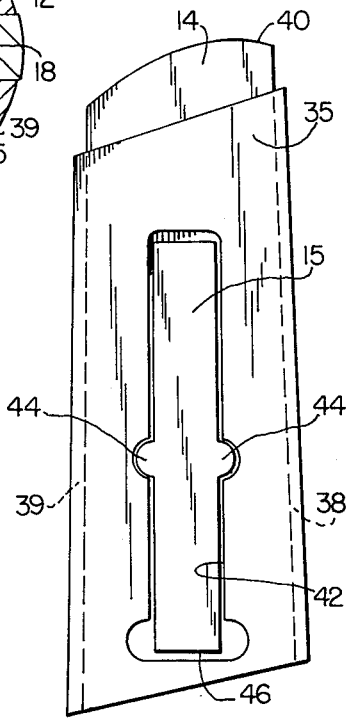
FIG. 4 is a somewhat enlarged elevational view of the inner side panel member shown in FIG. 1 with a retaining spring attached thereto.
Figure 5:
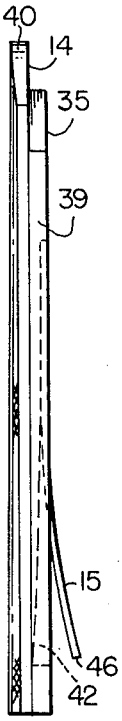
FIG. 5 is a rear edge view of the panel member shown in FIG. 4.

The panel members are or may be substantially identical, but of opposite hand, depending upon the specific requirement of the firearm. The illustrated panel member 14, shown in FIGS. 4–6, is a typical panel member and may be made from any suitable non-metallic material, but preferably, and as shown it is made from a plastic material which simulates walnut and has a substantially planar inner surface 35 and a convex longitudinally extending outer surface. The outer surface of the illustrated panel member 14 has a raised diamond pattern which provides a non-slip grip surface as shown in FIG. 1. The panel member 14 is shaped to be received within and substantially complement the channel 20. Front and rear edge surfaces 38 and 39, inclined outwardly from the inner surface 35 and generally toward each other, extend for some distance along the front and rear side of the panel member 14, as best shown in FIG. 5. At its upper end the panel member 14 has an upwardly facing end surface 40 which substantially complements the upper end wall 26 when the panel member 14 is assembled with the handle member 12.

A shallow longitudinally extending cavity 42 formed in the grip panel 14 opens through its inner surface 35 as best shown in FIG. 4. It should be noted that the lower portion of the cavity is somewhat deeper than the upper portion as will be apparent from FIGS. 5 and 6.

Figures 7, 8:
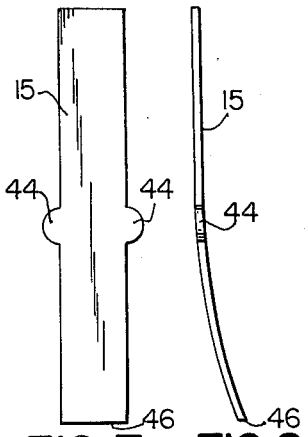
FIG. 7 is an elevational view of the inner side of the panel retaining spring.
FIG. 8 is an edge view of the spring of FIG. 7.

The spring 15 which retains the panel member 14, best shown in FIGS. 4–8, is somewhat bowed in its relaxed or undeformed condition, as it appears in FIG. 8. It is disposed within the cavity 42, and has integral generally centrally disposed ears 44, 44 which extend laterally outwardly from opposite sides thereof. The ears 44, 44 are received within complementary portions of the cavity 42 and aid in aligning the spring within the cavity 42 during assembly. The upper end portion of the spring 15 is received and retained within the relatively shallow upper end portion of the cavity 42. Various means may be provided for attaching the spring to the panel member 14, but preferably an epoxy adhesive compound is used to secure the upper portion of the spring 15 to the panel member 14 within the upper portion of the cavity 42. At its lower or free end the spring 15 has a transversely disposed and downwardly facing end surface 46.

Prior to assembly of the panel member with the handle member the lower end portion of the spring 15 is biased out of the cavity 42 and beyond the inner surface 35, as shown in FIGS. 5 and 6. However, the free lower end portion of the spring may be deflected from its retaining or full line position of FIG. 5 toward the panel member 14 and into the lower portion of the cavity 42 to a releasing position wherein it is disposed wholly within the cavity 42 and outwardly beyond the plane of the inner surface 35, the latter position being indicated in broken lines in FIG. 6.

In assemblying the panel member 14 with the handle member 12 the panel member is slid upwardly into the channel 20. The front and rear edge surfaces 38 and 39 on the panel member respectively engage the associated complementary front and rear walls 24 and 25 of the channel 20. As the spring 15 engages the inner wall 22, its free end is biased in an outward direction toward its releasing position and into the cavity 42. When the panel member 14 is in its proper position of assembly within the recess 20, the free end of the spring is biased into the recess 34 and the slot 30 and the surface 46 at the lower end of the spring engages the corresponding opposing surface 32 of the slot. The coengageable front and rear wall surfaces 24 and 25 and edge surfaces 38 and 39 on the handle member 12 and the panel member 14, respectively, restrain the panel member against lateral movement relative to the handle member. An upwardly facing abutment surface associated with the panel member, such as the upper end surface 40 engages a downwardly facing abutment surface associated with the frame 12, such as the upper end wall 26, to restrain the panel member against upward movement relative to the handle member 12. Engagement of the spring surface 46 with the opposing slot surface 12 serves to releasably retain the panel member 14 in assembly with the handle member 12 and restrain it against movement in at least one longitudinal direction within the channel 20.

The free end portion of the spring 15 is accessible through the magazine well 18 when the magazine (not shown) is removed from the pistol to facilitate removal of the panel member when the piston is stripped for cleaning. Specifically, the panel member is released by inserting one finger into the magazine well 18 and through the hole **28*c* and applying outwardly directed biasing force to the free end portion of the spring 15 to bias it to its releasing position whereupon the panel member 14 may be slidably removed from the handle member 12**.

Figure 9:
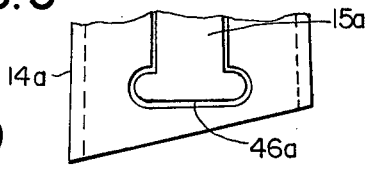
FIG. 9 is a fragmentary elevational view similar to FIG. 4, but shows another retaining spring arrangement.

In FIG. 9 there is shown another panel member **14*a* which carries a retaining spring 15*a*. The lower end portion of the spring 15*a* is shaped to compliment a slot 30 in the handle member 16, whereby the spring retains the panel member 14*a*** against movement in either longitudinal direction relative to the handle member.

I claim:

1. A firearm grip assembly comprising a handle member having a longitudinally extending channel opening laterally outwardly through one side and longitudinally outwardly through one end thereof, a panel member received in said channel, coengagable means on said handle member and said panel member for restraining said panel member against lateral movement relative to said handle member when said panel member is in assembled position within said channel, and concealed means carried by one of the members comprising said handle member and said panel member and engagable with the other of said members when said panel member is assembled with said handle member for releasably retaining said panel member in assembly with said handle member.

2. A firearm grip assembly as set forth in claim 1 wherein said concealed means is wholly disposed between said members when said panel member is in assembled position within said channel.

3. A firearm as set forth in either claim 1 or claim 2 wherein said concealed means comprises a spring.

4. A firearm as set forth in claim 2 wherein said concealed means comprises a flat spring having one of its end portions secured to said one member and the other of its end portions biased into engagement with the other of said members.

5. A firearm as set forth in claim 4 wherein said panel member comprises said one member and said handle member comprises said other member.

6. A firearm as set forth in either claim 4 or claim 5 wherein said one member has a cavity therein and said flat spring is secured to said one member within said cavity.

7. A firearm as set forth in claim 1 wherein said handle member has a magazine well opening through an end thereof and a hole therethrough communicating with said channel and said magazine well and said concealed means is accessible through said magazine well and said hole whereby said concealed means may be released from engagement with said other of said members.

8. A firearm grip assembly comprising a handle member having a longitudinally extending magazine well therein opening outwardly through one end thereof and a longitudinally extending channel therein opening laterally outwardly through one side thereof and through said one end, said channel being defined by an inner wall and generally opposing front and rear walls inclined outwardly and toward each other from said inner wall, said inner wall having a hole therethrough communicating with said magazine well and said channel, a panel member received within said channel and having front and rear edge surfaces respectively complementing said front and rear walls of said channel when said panel member is in assembled position in said channel, said panel member having an inner surface engaging said inner wall and longitudinally extending cavity therein opening through said inner surface, a longitudinally extending flat spring having one end portion thereof secured to said panel member within said cavity and the other end portion thereof disposed in lateral alignment with said hole and biased into engagement with said handle member, said handle member and said other end cooperating to releasably retain said panel member in assembly with said handle.

9. A firearm grip assembly as set forth in claim 8 wherein said handle member has a slot therein receiving said other end portion of said spring.

* * * * *

UNITED STATES PATENT AND TRADEMARK OFFICE

CERTIFICATE OF CORRECTION

PATENT NO. : 4,221,066

DATED : September 9, 1980

INVENTOR(S) : Robert L. Hillberg

It is certified that error appears in the above-identified patent and that said Letters Patent are hereby corrected as shown below:

Column 2, line 27, "gum" should be --gun--.

Column 3, line 48, "12" should be --32--.

Signed and Sealed this

*Twenty-fifth* Day of *November 1980*

[SEAL]

*Attest:*

SIDNEY A. DIAMOND

*Attesting Officer*

*Commissioner of Patents and Trademarks*